US010232488B2

(12) United States Patent
Brown et al.

(10) Patent No.: US 10,232,488 B2
(45) Date of Patent: Mar. 19, 2019

(54) ABRASIVE MACHINING APPARATUS FOR PROCESSING EDGES OF GLASS ARTICLES

(71) Applicant: Corning Incorporated, Corning, NY (US)

(72) Inventors: James William Brown, Painted Post, NY (US); Yao-Sheng Chen, Tainan (TW); Hsi-Ta Lin, Changhua (TW); Yuyin Tang, Yongzhou (CN); Naiyue Zhou, Painted Post, NY (US); Zepei Zhu, Corning, NY (US)

(73) Assignee: CORNING INCORPORATED, Corning, NY (US)

( * ) Notice: Subject to any disclaimer, the term of this patent is extended or adjusted under 35 U.S.C. 154(b) by 0 days.

(21) Appl. No.: 15/511,849

(22) PCT Filed: Sep. 22, 2015

(86) PCT No.: PCT/US2015/051296

§ 371 (c)(1),
(2) Date: Mar. 16, 2017

(87) PCT Pub. No.: WO2016/048924

PCT Pub. Date: Mar. 31, 2016

(65) Prior Publication Data

US 2017/0304981 A1 Oct. 26, 2017

Related U.S. Application Data

(60) Provisional application No. 62/053,390, filed on Sep. 22, 2014.

(51) Int. Cl.

| | |
|---|---|
| ***B24B 9/10*** | (2006.01) |
| ***B24B 47/22*** | (2006.01) |
| ***B24B 9/08*** | (2006.01) |

(52) U.S. Cl.
CPC ..... *B24B 9/10* (2013.01); *B24B 9/08* (2013.01); *B24B 47/22* (2013.01)

(58) Field of Classification Search
CPC ..... B24B 47/22; B24B 9/10; B24B 9/08
See application file for complete search history.

(56) References Cited

U.S. PATENT DOCUMENTS

| | | | |
|---|---|---|---|
| 858,887 | A | 7/1907 | Millen |
| 1,724,677 | A | 8/1929 | Owen |

(Continued)

FOREIGN PATENT DOCUMENTS

| | | | |
|---|---|---|---|
| CN | 2702813 | Y | 6/2005 |
| CN | 203031467 | U | 7/2013 |

(Continued)

OTHER PUBLICATIONS

PCT Search Report, dated Feb. 1, 2016.
English Translation of CN201580062628.7 First Office Action dated Sep. 6, 2018, China Patent Office, 13 Pgs.

*Primary Examiner* — Marc Carlson
(74) *Attorney, Agent, or Firm* — Kevin M. Able

(57) ABSTRACT

Abrasive machining apparatuses and methods of finishing glass articles with abrasive machining apparatuses are disclosed herein. In one embodiment, an abrasive machining apparatus includes a support base, an edge finishing unit, and an edge finishing unit position sensor. The edge finishing unit includes an abrasive machining spindle having an abrasive wheel that is coupled to a motor and a pivot mechanism that is coupled to the support base. The pivot mechanism has an axis about which the abrasive machining spindle pivots. The abrasive machining spindle is pivotable between an extended position and a retracted position. The actuator is coupled to the edge finishing unit and to the support base and selectively positions the abrasive machining spindle about the axis. The edge finishing unit position (Continued)

sensor is coupled to the support base and is oriented to detect a position of the abrasive machining spindle.

19 Claims, 8 Drawing Sheets

(56) References Cited

U.S. PATENT DOCUMENTS

| | | | | |
|---|---|---|---|---|
| 2,826,872 | A | 3/1958 | Robbins | |
| 3,805,455 | A | 4/1974 | Aellig et al. | |
| 3,849,944 | A | 11/1974 | Noll | |
| 4,060,937 | A | 12/1977 | Glazer | |
| 6,196,902 | B1 * | 3/2001 | Gazca-Ortiz | B24B 9/10 451/178 |
| 6,985,791 | B2 | 1/2006 | Malkin et al. | |
| 7,001,249 | B1 | 2/2006 | Pride et al. | |
| 7,018,272 | B2 * | 3/2006 | Allaire | B24B 9/102 451/11 |
| 7,191,030 | B2 | 3/2007 | Videcoq | |
| 7,235,002 | B1 * | 6/2007 | Pride | B24B 9/102 451/121 |
| 7,294,045 | B1 | 11/2007 | Brown et al. | |
| 8,282,443 | B2 | 10/2012 | Vianello et al. | |
| 8,721,392 | B2 * | 5/2014 | Brown | B24B 9/102 451/43 |
| 2005/0026541 | A1 * | 2/2005 | Allaire | B24B 9/102 451/5 |
| 2007/0138228 | A1 | 6/2007 | Brown et al. | |
| 2010/0112910 | A1 * | 5/2010 | Brown | B24B 9/10 451/44 |
| 2011/0104988 | A1 * | 5/2011 | Wenninger | B24B 9/10 451/5 |
| 2014/0030959 | A1 * | 1/2014 | Brown | B24B 9/10 451/44 |

FOREIGN PATENT DOCUMENTS

| | | | | |
|---|---|---|---|---|
| EP | 1060833 | B1 | 1/2005 | |
| GB | 467129 | A | 6/1937 | |
| GB | 984926 | A | 3/1965 | |
| JP | 06335851 | A | 12/1994 | |
| JP | 2013158877 | A | 8/2013 | |
| WO | 2000036543 | A1 | 6/2000 | |
| WO | 2011031506 | A2 | 3/2011 | |
| WO | WO 2012162223 | A1 * | 11/2012 | B24B 9/08 |

* cited by examiner

ABRASIVE MACHINING APPARATUS FOR PROCESSING EDGES OF GLASS ARTICLES

CROSS-REFERENCE TO RELATED APPLICATIONS

This application claims the benefit of priority under 35 U.S.C. § 119 of U.S. Provisional Application Ser. No. 62/053,390 filed on Sep. 22, 2014, the content of which is relied upon and incorporated herein by reference in its entirety.

BACKGROUND

Field

The present specification generally relates to apparatuses for processing edges of glass articles.

Technical Background

Glass articles are used in a variety of industrial applications. When glass articles are produced for a particular end-user application, the large glass articles may be separated from larger pieces of glass, including being separated from a continuously-formed web of glass. Because of this separation process, the edges of the glass articles may include surface irregularities. It is conventionally known to process the edges of these glass articles to reduce the surface irregularities and thereby improve strength and decrease susceptibility to breakage of the glass article when introduced to downstream industrial applications.

Accordingly, a need may exist for abrasive machining apparatuses that process glass articles to remove surface irregularities that may arise during the manufacturing operations of the glass articles.

SUMMARY

According to one embodiment, an abrasive machining apparatus includes a support base, an edge finishing unit, and an edge finishing unit position sensor. The edge finishing unit includes an abrasive machining spindle having an abrasive wheel that is coupled to a motor and a pivot mechanism that is coupled to the support base. The pivot mechanism has an axis about which the abrasive machining spindle pivots. The abrasive machining spindle is pivotable between an extended position and a retracted position. The actuator is coupled to the edge finishing unit and to the support base and selectively positions the abrasive machining spindle about the axis between the extended position and the retracted position. The edge finishing unit position sensor is coupled to the support base and is oriented to detect a position of the abrasive machining spindle between the extended position and the retracted position.

In another embodiment, a method of finishing a glass article includes translating a glass article with a feed mechanism in a feed direction, positioning an abrasive machining spindle having an abrasive wheel in an initiation position in which the abrasive wheel is positioned to intersect of an edge of the glass article that is generally parallel to the feed direction, and detecting when the abrasive wheel contacts the edge of the glass article at a position proximate to a leading corner of the glass article. The method also includes, subsequent to detecting that the abrasive wheel contacts the edge of the glass article, applying a force to the abrasive machining spindle with an actuator in a direction that tends to pivot the abrasive machining spindle in a cross-feed direction that is transverse to the feed direction and into the glass article. The method further includes processing the edge of the glass article by abrasive machining.

In yet another embodiment, an abrasive machining apparatus for finishing glass includes a feed mechanism that translates a glass article in a feed direction, a support base, an edge finishing unit that includes an abrasive machining spindle having an abrasive wheel coupled to a motor and a pivot mechanism that is coupled to the support base and having an axis about which the abrasive machining spindle pivots. The abrasive machining spindle is pivotable between an extended position and a retracted position. The apparatus also includes an actuator coupled to the edge finishing unit and the support base. The actuator selectively positions the abrasive machining spindle about the axis between the extended position and the retracted position. The apparatus further includes an edge finishing unit position sensor that is coupled to the support base and is oriented to detect a position of the abrasive machining spindle between the extended position and the retracted position. The apparatus also includes a controller having a processor and a non-volatile memory storing computer-readable logic. When the computer-readable logic is executed by the processor, the controller commands the actuator to maintain the abrasive machining spindle in an initiation position between the extended position and the retracted position, detects movement of the abrasive machining spindle from the initiation position with the edge finishing unit position sensor to determine when contact between the abrasive wheel and the glass article occurs, and commands the actuator to modify an application of force to pivot the abrasive machining spindle to an engaged position between the initiation position and the extended position after contact between the abrasive wheel and the glass article has occurred.

Additional features and advantages will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
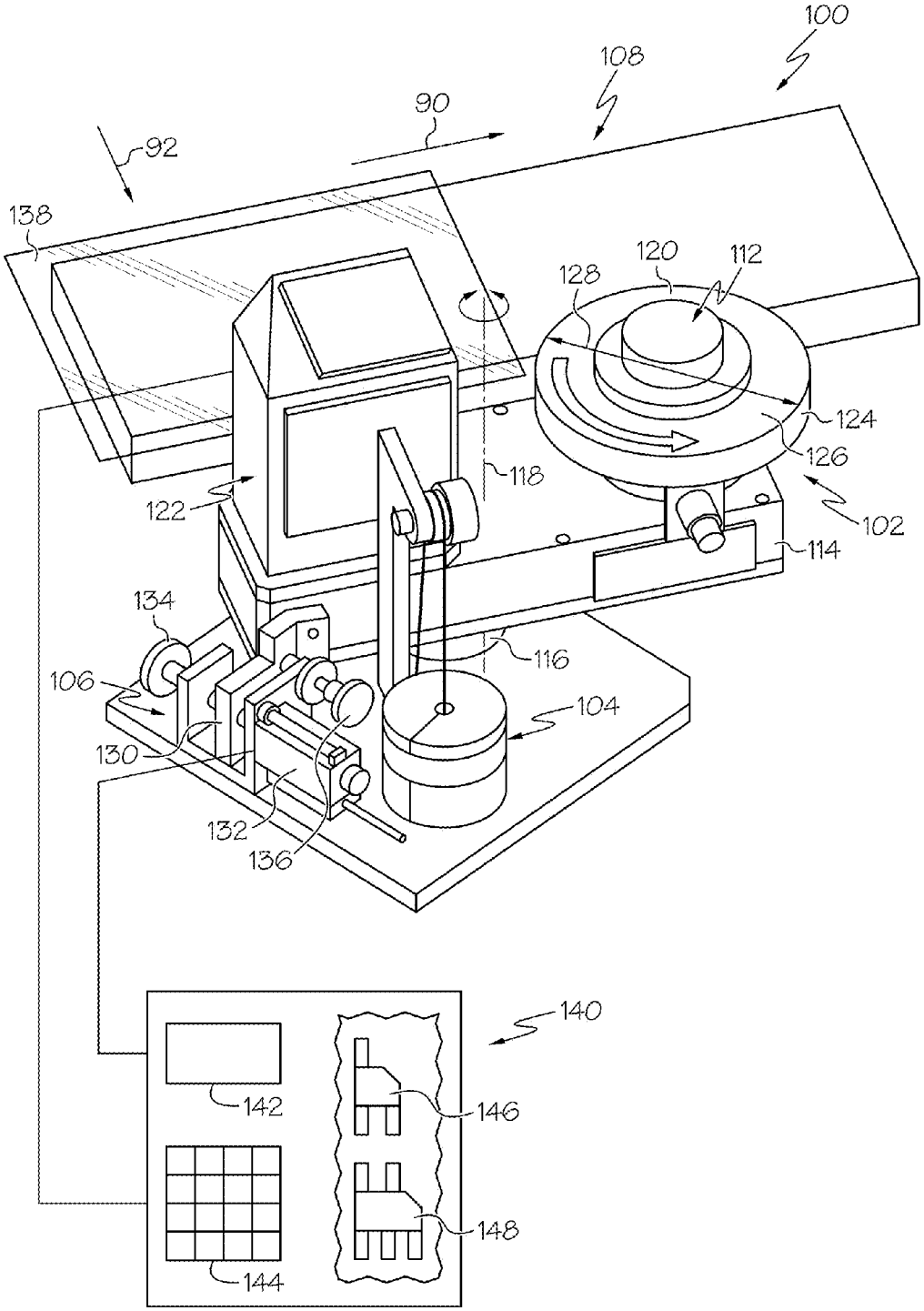
FIG. 1 schematically depicts a perspective view of an abrasive machining apparatus according to one or more embodiments described herein.

Abrasive machining apparatuses according to the present disclosure include an edge finishing unit whose operation is dynamically controlled by a control system based on the position of the glass article relative to the edge finishing unit. The edge finishing unit includes an abrasive machining spindle having an abrasive wheel that is coupled to a motor. The abrasive machining spindle is pivoted between an extended position and a retracted position by a pivot mechanism. The glass articles may be introduced to the edge finishing unit sequentially. The control system determines the position of the forward boundary of the incoming glass article and modifies the position of the abrasive machining spindle to perform the designated machining operation. As the glass article passes through the edge finishing unit, the control system determines the position of the rearward boundary of the glass article. The control system may modify the position of the abrasive machining spindle to prevent the abrasive machining spindle from pivoting toward the glass article as the rearward boundary of the glass article passes the abrasive wheel, which may prevent the abrasive wheel from rounding the trailing corner of the glass article.

Conventionally known glass sheet separation processes separate larger glass sheets into glass articles for a particular end-user application. Such glass sheet separation processes may include scribe-and-bend or laser separation techniques. Using either of these separation techniques may result in surface imperfections in the separated edges of the glass article. These surface imperfections may be stress concentrators in the glass article, which may reduce the strength of the glass article. The surface imperfections may increase the susceptibility of the glass article to break during subsequent handling or processing. Breakage of glass articles during manufacturing operations may adversely impact the costs of manufacturing, and may result in reduced system up-time caused by removal of broken glass.

Abrasive machining apparatuses according to the present disclosure may process the edges of the glass articles to reduce surface imperfections in the edges of the glass articles. The abrasive machining apparatuses may also maintain evenness of the abrasive machining operation along the edge of the glass article so that the edges of the glass article are generally uniform. The abrasive machining apparatuses may also maintain contact with the edges of the glass article for an extended duration, such that the abrasive machining operation can be applied to much of the edge.

As discussed hereinabove, the likelihood of glass article breakage may be attributed to the quality of the glass and the finished edges of the glass article. Conventional edge finishing techniques may include a multistep abrasive machining process that includes grinding of the edge of the glass article to remove the defects introduced by separating the glass web into glass articles and polishing of the edge of the glass article to remove surface defects that were introduced by the grinding process. The grinding process may modify the shape of the edge of the glass article to introduce a shape to the edge of the glass article that is desirable for subsequent handling and machining operations in the manufacturing process, including edge shapes having bevels or rounds between the top surface of the glass article and the bottom surface of the glass article.

The polishing process removes material from the edge of the glass articles according to the shape that is introduced to the edges in the grinding process. Conventionally known edge polishers typically do not engage a glass article at its leading or trailing corners to avoid inadvertently rounding the corner. Avoiding engagement of the edges at the leading and trailing corners may leave a significant portion of the edge of the glass article unfinished, which may result in an increased defective part rate.

The present disclosure is directed to abrasive machining apparatuses that may be used in a grinding operation or a polishing operation. The abrasive machining apparatuses according to the present disclosure engage the edge of a glass articles at positions proximate to the leading and trailing corners of the glass article to abrasively machine the maximum length of the edge of the glass article. Abrasive machining apparatuses according to the present disclosure incorporate an actuator that pivots the abrasive machining spindle of the edge finishing unit between extended and retracted positions through the use of a controller. The controller commands the actuator to pivot the abrasive machining spindle between different positions based on contact with the glass article, decreasing the interval between the time at which the glass article enters the abrasive machining station and the time at which the abrasive wheel engages the glass article. As a result, the amount of edge of the glass article that is not processed by the abrasive machining apparatus is minimized. The lack of processing of edges of the glass article may become more acute as the processing speed of the glass articles increases.

Additionally, the abrasive machining apparatuses of the present disclosure also actively monitor the wear of the abrasive wheel and adjust the position of the abrasive wheel accordingly to compensate for that wear.

Various embodiments of abrasive machining apparatuses for processing edges of glass articles will be described in more detail herein with reference to the appended drawings.

Referring now to FIG. 1, an abrasive machining apparatus 100 includes a support base 114, an edge finishing unit 102, and an actuator 106. The abrasive machining apparatus 100 may also include a feed mechanism 108 that directs a glass article 138 in a feed direction 90. The abrasive machining apparatus 100 may also include a controller 140 that controls operation of the actuator 106.

The edge finishing unit 102 may include an abrasive machining spindle 112 to which a motor 122 and an abrasive wheel 120 are coupled. The abrasive machining spindle 112 is rotatably coupled to the support base 114 by a pivot mechanism 116. The pivot mechanism 116 allows the abrasive machining spindle 112 to pivot about an axis 118. In one embodiment, the pivot mechanism 116 may include a bearing member (not shown) that provides longitudinal support along the axis 118 to the abrasive machining spindle 112 while allowing the abrasive machining spindle 112 to pivot about the axis 118.

In the embodiment depicted in FIG. 1, the edge finishing unit 102 is coupled to a counterbalance assembly 104 and the actuator 106. The counterbalance assembly 104 is coupled to the abrasive machining spindle 112 and to the support base 114 of the abrasive machining apparatus 100. In the depicted embodiment, the counterbalance assembly 104 incorporates weights that apply a force to the abrasive machining spindle 112 through a linkage. In other embodiments, the counterbalance assembly may include a torsion spring (not shown) that applies a force to the abrasive machining spindle 112. The counterbalance assembly 104 is configured to apply a biasing force to the abrasive machining spindle 112. As used herein, "biasing force" refers to a continuous and directional force that is applied to the abrasive machining spindle 112 in a direction that tends to pivot the abrasive machining spindle 112 toward a retracted position. The magnitude of the biasing force may be overcome by other applied forces to modify the position of the abrasive machining spindle 112, as will be discussed below.

The actuator 106 is coupled to the support base 114 and to the abrasive machining spindle 112 of the edge finishing unit 102. The actuator 106 selectively applies a force to the edge finishing unit 102 to pivot the abrasive machining spindle 112 between a retracted position and an extended position. The actuator 106 may be selected from a variety of conventionally known actuators including servomotors, pneumatic actuators, hydraulic actuators, or electromechanical actuators. In some embodiments, the actuator 106 may apply a force in a direction that pivots the abrasive machining spindle 112 toward the extended position. In such embodiments, the actuator 106 relies on the biasing force provided by the counterbalance assembly 104 to selectively reposition the abrasive machining spindle 112.

In the embodiment depicted in FIG. 1, the abrasive machining apparatus 100 includes a pivot arm 130 that is coupled to and extends from the abrasive machining spindle 112. The actuator 106 is coupled to the pivot arm 130. The pivot arm may increase the force that the actuator 106 can apply to the abrasive machining spindle 112 through improved leverage. As further depicted in FIG. 1, the abrasive machining apparatus 100 includes a plurality of mechanical stops 134, 136. The mechanical stops 134, 136 may contact a portion of the abrasive machining spindle 112 (for example, the pivot arm 130, as depicted in FIG. 1). The mechanical stops 134, 136 may limit the maximum rotational range of the abrasive machining spindle 112. In some embodiments, the mechanical stops 134, 136 may define the extended position and the retracted position between which the abrasive machining spindle 112 pivots.

The abrasive machining apparatus 100 also includes an edge finishing unit position sensor 132. In the embodiment depicted in FIG. 1, the edge finishing unit position sensor 132 is coupled to the support base 114 and evaluates a position of the pivot arm 130, whose position corresponds to the position of the abrasive machining spindle 112. Operation of the actuator 106 and the edge finishing unit position sensor 132 will be discussed in more detail below.

As depicted in FIG. 1, the abrasive machining apparatus 100 further includes a feed mechanism 108. A feed mechanism 108 according to the present disclosure may include any conventionally known machine that secures and translates a glass article for processing. Examples of such feed mechanisms include conveyor systems, mechanical clamping systems, vacuum clamping systems, and the like. In the embodiment depicted in FIG. 1, the feed mechanism 108 secures and translates a glass article 138 in a feed direction 90. The edge finishing unit 102 is positioned proximate to the feed mechanism 108 such that as the glass article 138 is translated toward and along the edge finishing unit 102, the edge finishing unit 102 is positioned to process the edge of the glass article 138.

Still referring to FIG. 1, abrasive machining apparatus 100 includes a controller 140 that is electronically coupled to the actuator 106 and to the edge finishing unit position sensor 132. In some embodiments, the controller 140 is electronically coupled to motor 122 of the edge finishing unit 102. The controller 140 includes a processor 146 and a non-volatile memory 148 that is electronically coupled to the processor 146 and stores a computer-readable instruction set. As depicted in FIG. 1, the controller 140 also includes a display 142 and a user interface 144 that are electronically coupled to the processor. In some embodiments, the controller 140 may be a programmable logic controller. In other embodiments, the controller may be a general purpose computer that includes input and output connections to accept inputs from at least the edge finishing unit position sensor 132 and deliver outputs to the actuator 106.

The controller 140, through instructions provided to the actuator 106, modifies the position of the pivot arm 130 relative to the support base 114. The controller 140 detects when the glass article 138 is in a position proximate to the abrasive wheel 120. When the controller 140 determines that the glass article 138 is in a position at which the edges of the glass article 138 can be processed, the controller 140 commands the actuator 106 to modify an application of force to the abrasive machining spindle 112 such that the abrasive machining spindle 112 pivots about the pivot mechanism 116 into an extended position where the abrasive wheel 120 processes the glass article 138. The feed mechanism 108 traverses the glass article 138 in the feed direction 90 as the glass article 138 is being processed. As the controller 140 detects that the glass article 138 is being translated away from a position at which the edges of the glass article 138 can be processed, the controller 140 commands the actuator 106 to modify the application of force to the abrasive machining spindle 112 such that the abrasive machining spindle 112 pivots about the pivot mechanism 116 into a retracted position where the abrasive wheel 120 is spaced apart from contact with the glass article 138 in the cross-feed direction 92.

Figure 2:
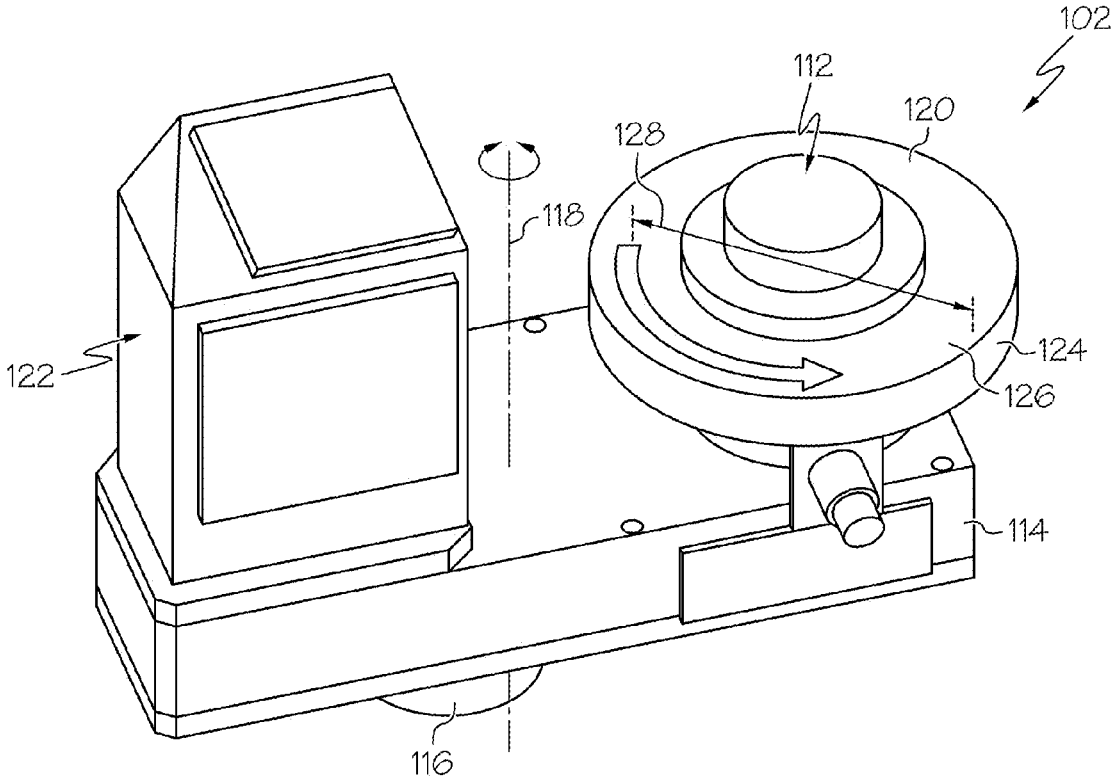
FIG. 2 schematically depicts a perspective view of the edge finishing unit of an abrasive machining apparatus according to one or more embodiments described herein.

Referring now to the embodiment depicted in FIG. 2, the edge finishing unit 102 includes the abrasive machining spindle 112, the support base 114, and the pivot mechanism 116. The abrasive machining spindle 112 includes an abrasive wheel 120 coupled to the motor 122. The motor 122 is rotationally coupled to the abrasive wheel 120. The motor 122 imparts torque to the abrasive wheel 120 such that the abrasive wheel 120 can abrasively machine the glass article 138. An abrasive wheel 120 according to the present disclosure may be used to perform manufacturing operations classified as grinding or polishing, in which the abrasive wheel 120 includes an embedded abrasive media that is collected in a wheel bond. As the embedded abrasive media of the abrasive wheel 120 comes into contact with the workpiece, the embedded abrasive media removes material from the workpiece. An abrasive wheel 120 according to the present disclosure may be of any size or material suitable to the abrasive machining apparatus 100. In the embodiment depicted in FIG. 2, the abrasive wheel 120 is a form wheel 124 that includes an interior profile that generally corresponds to the desired finished shape of the workpiece. Other examples of abrasive wheels that may be suitable for use with the abrasive machining apparatuses 100 include, for example and without limitation, straight wheels, cylinder wheels, tapered wheels, straight cup wheels, dished cup wheels, and the like. An abrasive wheel 120 according to the present disclosure may incorporate a variety of embedded abrasive media including, for example and without limitation, aluminum oxide, silicon carbine, diamond, cubic boron nitride, and the like.

Figure 3:
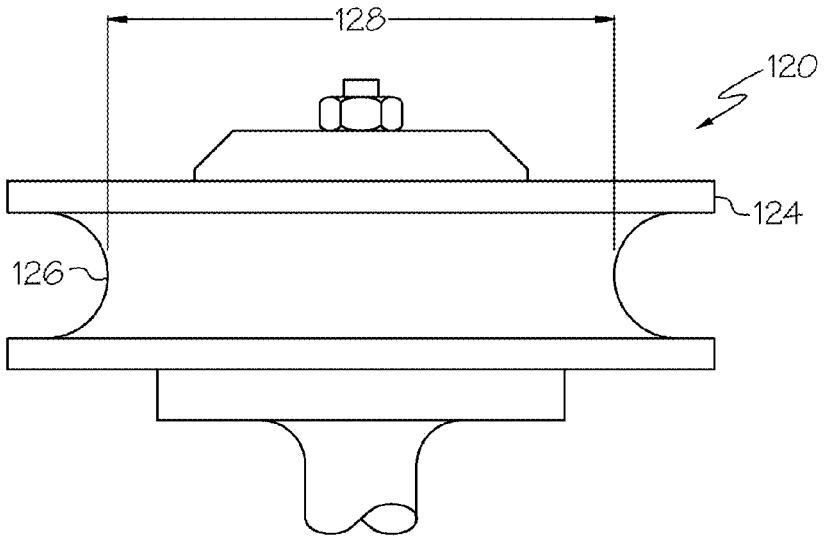
FIG. 3 schematically depicts a perspective view of the abrasive wheel according to one or more embodiments described herein.

Referring now to FIG. 3, the abrasive wheel 120 includes a form wheel 124 with an interior profile 126 that engages with and machines the glass article 138. The interior profile 126 of the form wheel 124 has a characteristic diameter 128. In the embodiment depicted in FIG. 3, the characteristic diameter 128 is measured at the narrowest position of the form wheel 124. As the abrasive machining system progresses, the interior profile 126 of the form wheel 124 may modify in profile and/or diameter due to wear. The wear may decrease the characteristic diameter 128 of the form wheel 124. If the wear of the form wheel 124 is not compensated for, the wear may lead to variation in the manufacturing operation, including introduction of dimensional inaccuracies of finished components. Accordingly, the abrasive machining apparatus 100 may compensate for such wear of the form wheel 124, which is discussed in more detail below.

Figure 4:
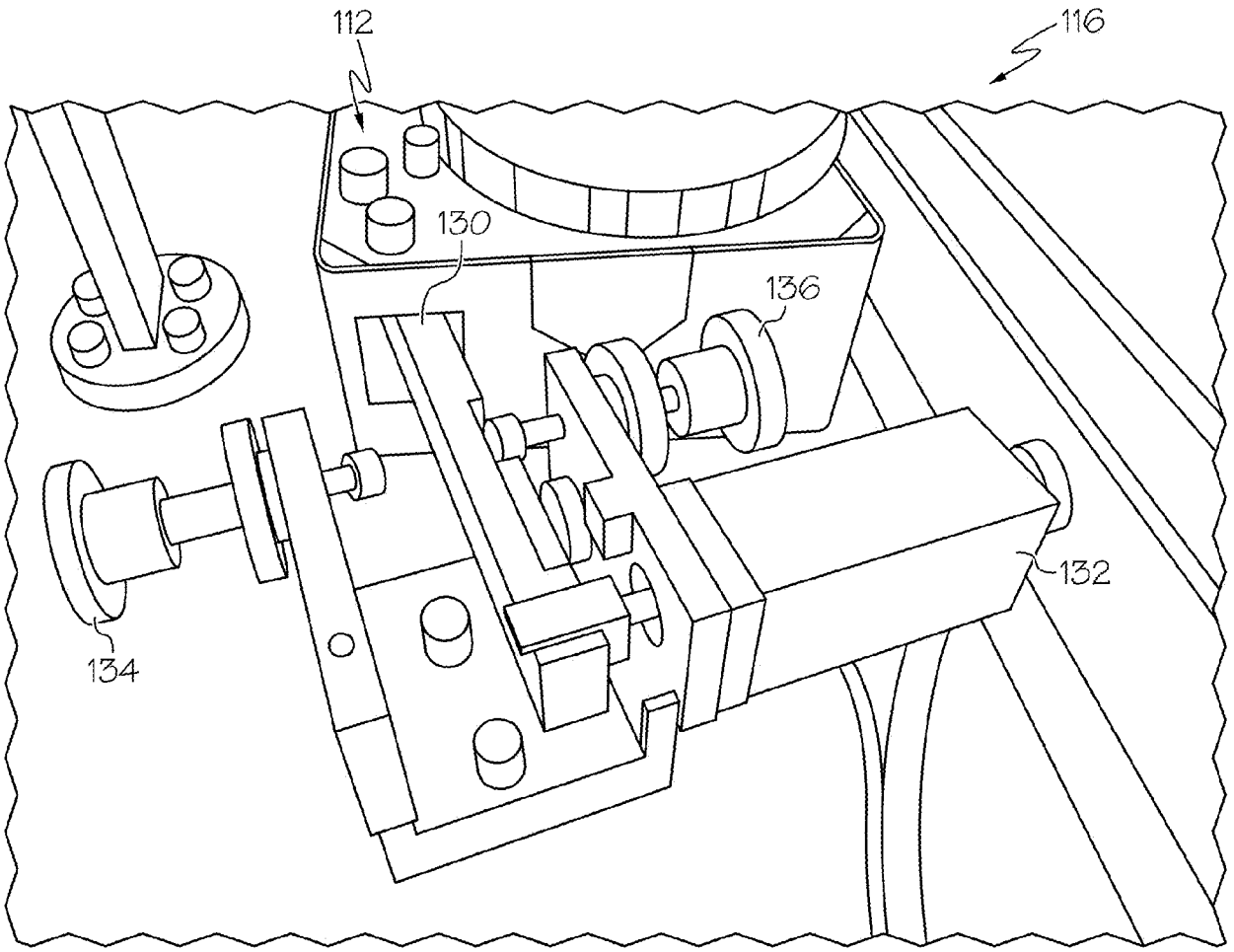
FIG. 4 schematically depicts a perspective view of an abrasive machining apparatus according to one or more embodiments described herein.

Referring now to FIG. 4, the pivot mechanism 116 allows the abrasive machining spindle 112 to pivot about an axis such that the abrasive wheel of the abrasive machining spindle 112 can be translated through a variety of positions evaluated in a cross-feed direction that is transverse to the feed direction. The abrasive machining apparatus includes a pivot arm 130, an edge finishing unit position sensor 132, and a plurality of mechanical stops 134, 136. In the depicted embodiment, the edge finishing unit position sensor 132 is coupled to the support base 114 and positioned to sense movement of the pivot arm 130 relative to the support base 114.

The process of processing the glass article 138 will now be explained with reference to FIGS. 5-8. As discussed hereinabove, the abrasive machining spindle 112 is pivoted about the axis 118 between a plurality of positions including a fully retracted position 150, an engaged position 154, and an initiation position 152 positioned between the fully retracted position 150 and the engaged position 154.

Discussion of the positions through which the abrasive machining spindle 112 is pivoted is made with reference to the glass article 138 that is processed by the abrasive machining apparatus 100. The glass article 138 is introduced to the abrasive machining apparatus 100 by the feed mechanism 108, which translates the glass article 138 in the feed direction 90 toward the edge finishing unit 102. In the embodiment depicted in FIGS. 5-9, the glass article 138 is processed along a proximate edge 162 that extends in a direction that is generally parallel to the feed direction 90. The proximate edge 162 of the glass article 138 is generally positioned proximate to the abrasive wheel 120 for processing. The glass article 138 has a leading corner 158 that is positioned at the intersection of the proximate edge 162 and a forward edge 161 of the glass article 138 that is oriented in the feed direction 90. The glass article 138 also has a trailing corner 160 that is positioned at the intersection of the proximate edge 162 and a trailing edge 163 of the glass article 138 that is oriented opposite the feed direction 90.

Figure 5:
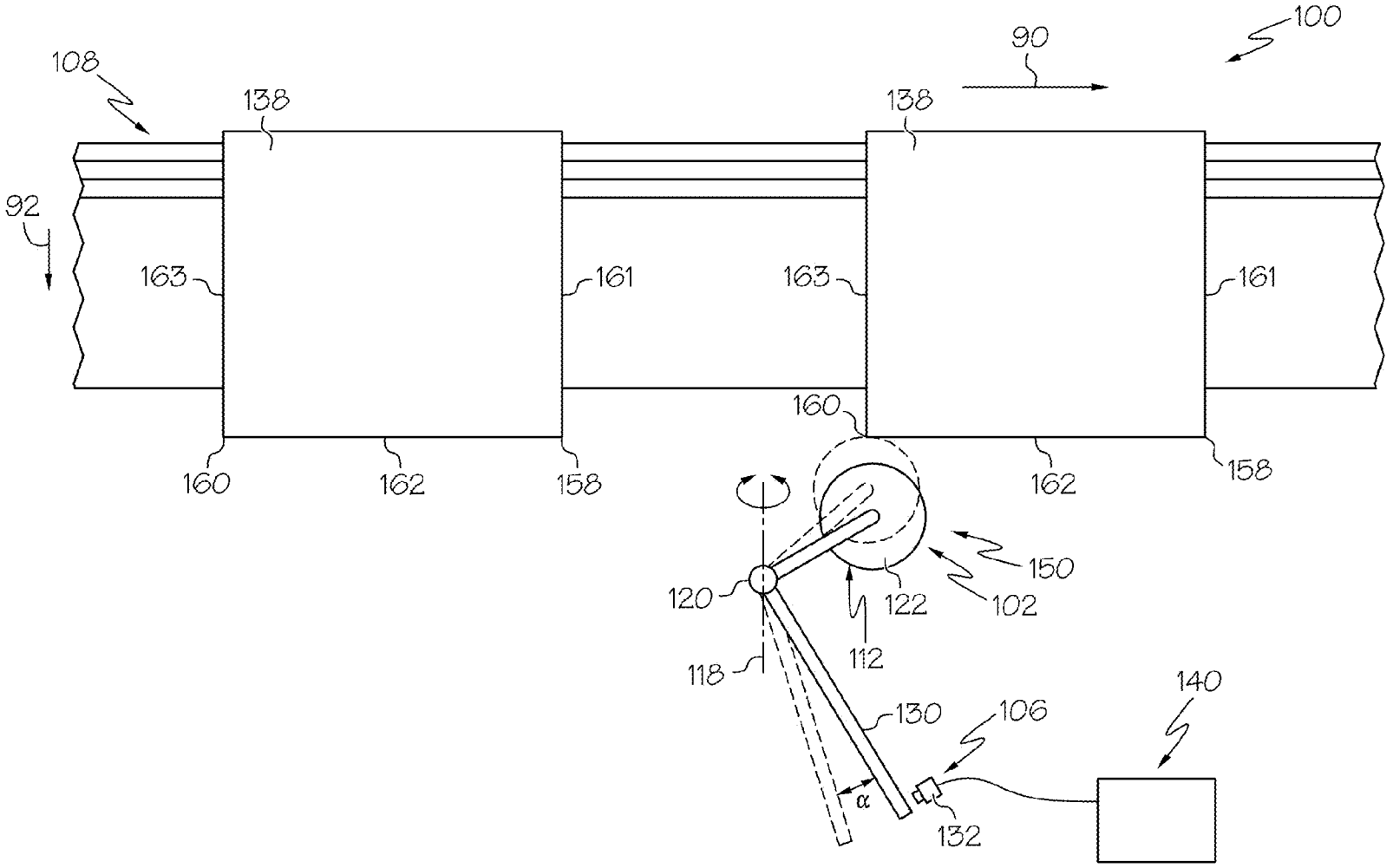
FIG. 5 schematically depicts a top view of the abrasive machining apparatus according to one or more embodiments described herein.

Referring now to FIG. 5, the abrasive machining spindle 112 is shown in the fully retracted position 150. The abrasive machining spindle 112 is maintained in the fully retracted position 150 when the abrasive wheel 120 is free from engagement with the glass article 138 when evaluated in the cross-feed direction 92.

Figure 6:
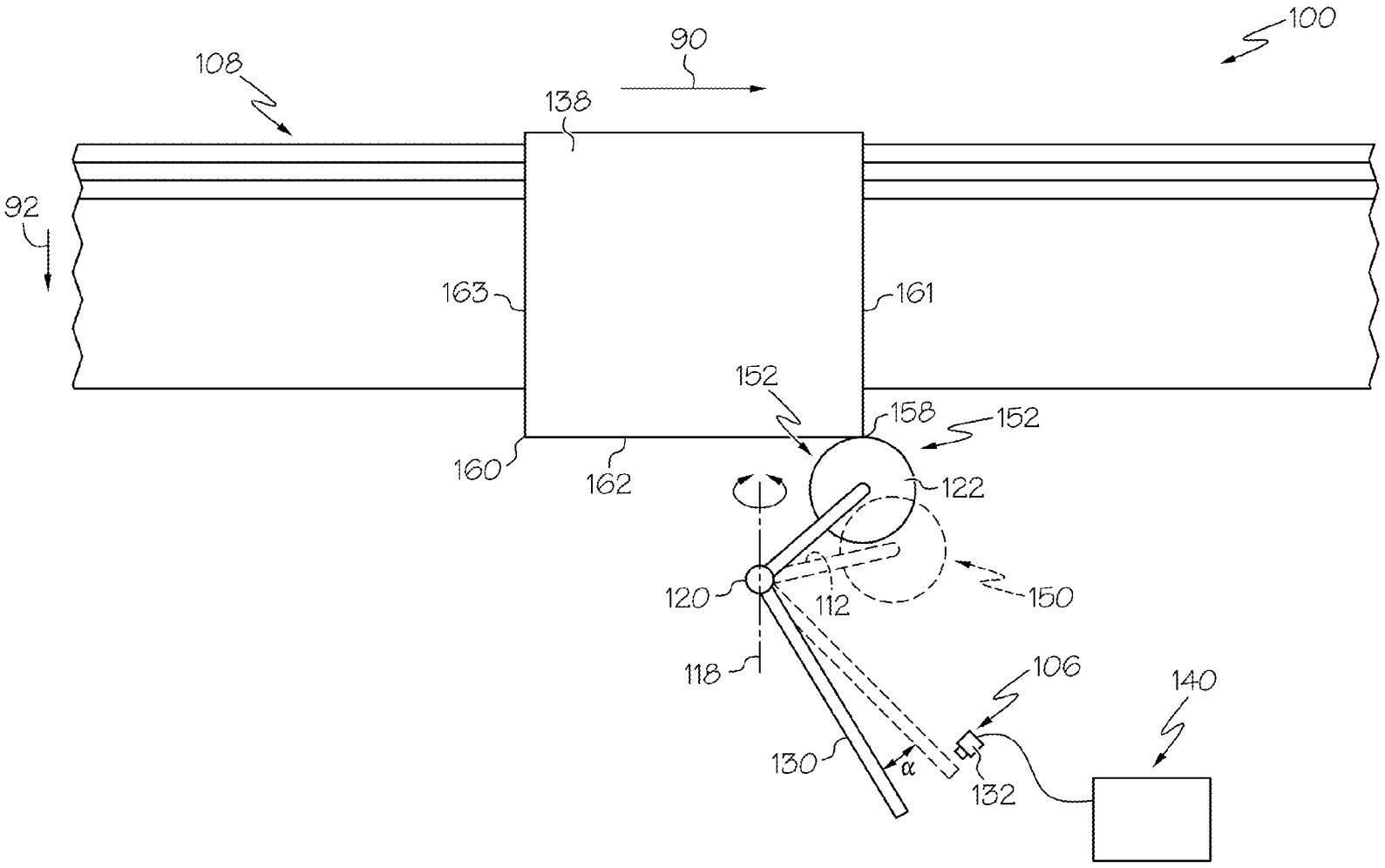
FIG. 6 schematically depicts a top view of the abrasive machining apparatus according to one or more embodiments described herein.

Referring now to FIG. 6, the abrasive machining spindle 112 is shown being pivoted from the fully retracted position 150 to the initiation position 152. The abrasive machining spindle 112 is pivoted to the initiation position 152 prior to when the controller 140 determines that contact between the abrasive wheel 120 occurs. In embodiments of the abrasive machining apparatus 100, the controller 140 may maintain the position of the abrasive machining spindle 112 in the initiation position 152 such that a portion of the abrasive wheel 120 is positioned to contact the glass article 138 as the glass article 138 is traversed by the feed mechanism 108. For example, the characteristic diameter of the abrasive wheel 120 may be positioned to contact the proximate edge 162 of the glass article 138. The characteristic diameter of the abrasive wheel 120 may be positioned at an overlap distance from the un-machined proximate edge 162 of the glass article 138. In some embodiments, the overlap distance between the characteristic diameter 128 of the abrasive wheel 120 and the proximate edge 162 of the glass article 138, which represents the depth of contact between the abrasive wheel 120 and the glass article 138, is about 0.05 mm.

When the glass article 138 is translated to contact the abrasive wheel 120, the glass article 138 may introduce a force to the abrasive wheel 120 that tends to push the abrasive wheel 120 away from the proximate edge 162 of the glass article 138. This introduction of force, therefore, may tend to pivot the abrasive machining spindle 112 away from the proximate edge 162 of the glass article 138.

The controller 140, through a signal provided by the edge finishing unit position sensor 132, may determine that the abrasive machining spindle 112 has pivoted away from the initiation position 152. Through evaluating the pivot motion of the abrasive machining spindle 112, the controller 140 may determine that the abrasive wheel 120 has contacted the proximate edge 162 of the glass article 138.

Figure 7:
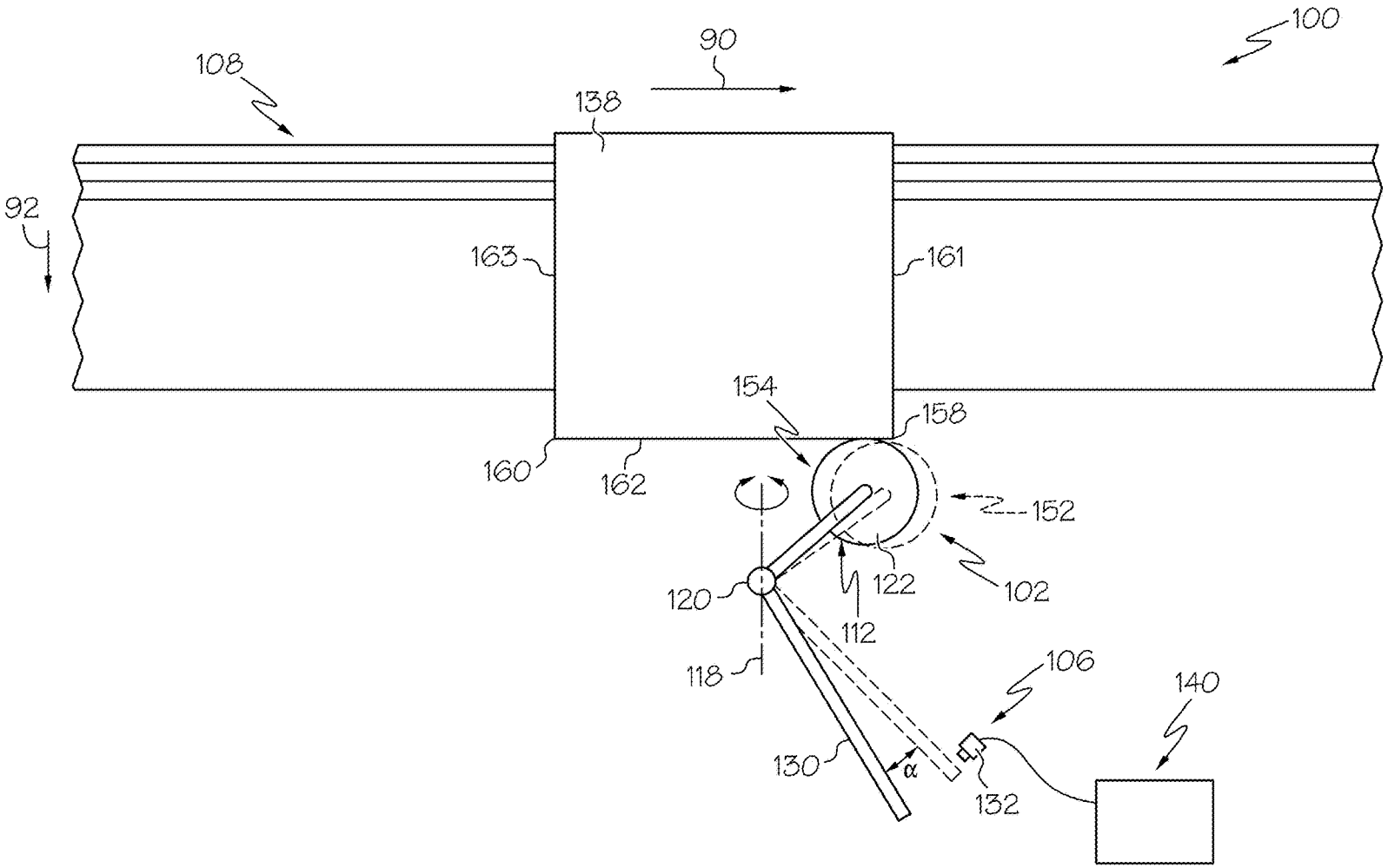
FIG. 7 schematically depicts a top view of the abrasive machining apparatus according to one or more embodiments described herein.

Referring now to FIG. 7, upon confirmation of contact between the abrasive wheel 120 and the proximate edge 162 of the glass article 138, the controller 140, following the instructions of the computer readable logic, commands the actuator 106 to modify the application of force to the abrasive machining spindle 112 to pivot the abrasive machining spindle 112 into an engaged position 154. The controller 140 commands the edge finishing unit position sensor 132 to modify the application of force that is directed into the pivot arm 130 and displace the abrasive machining spindle 112 by an angle $\alpha$. The rotation of the abrasive machining spindle 112 by the angle $\alpha$ causes the abrasive machining spindle 112 to pivot from the initiation position 152 to the engaged position 154. The abrasive machining spindle 112 is pivoted about the axis 118 toward the feed mechanism 108 (and therefore the glass article 138) in a cross-feed direction 92 that is transverse to the feed direction 90. While the abrasive machining spindle 112 is positioned in the engaged position 154, the abrasive wheel 120 is positioned to process the proximate edge 162 of the glass article 138 in an abrasive machining operation.

In the embodiment depicted in FIG. 7, the characteristic diameter 128 of the abrasive wheel 120 is positioned to contact the proximate edge 162 of the glass article 138. The characteristic diameter of the abrasive wheel 120 may be positioned at an overlap distance from the un-machined proximate edge 162 of the glass article 138. This overlap distance between the characteristic diameter of the abrasive wheel 120 and the proximate edge 162 of the glass article 138 may reflect the material that is removed from the glass article 138 during the abrasive machining process. In some embodiments, the overlap distance between the characteristic diameter of the abrasive wheel 120 and the proximate edge 162 of the glass article 138, which represents the depth of contact between the abrasive wheel 120 and the glass article 138, is about 0.70 mm.

Figure 8:
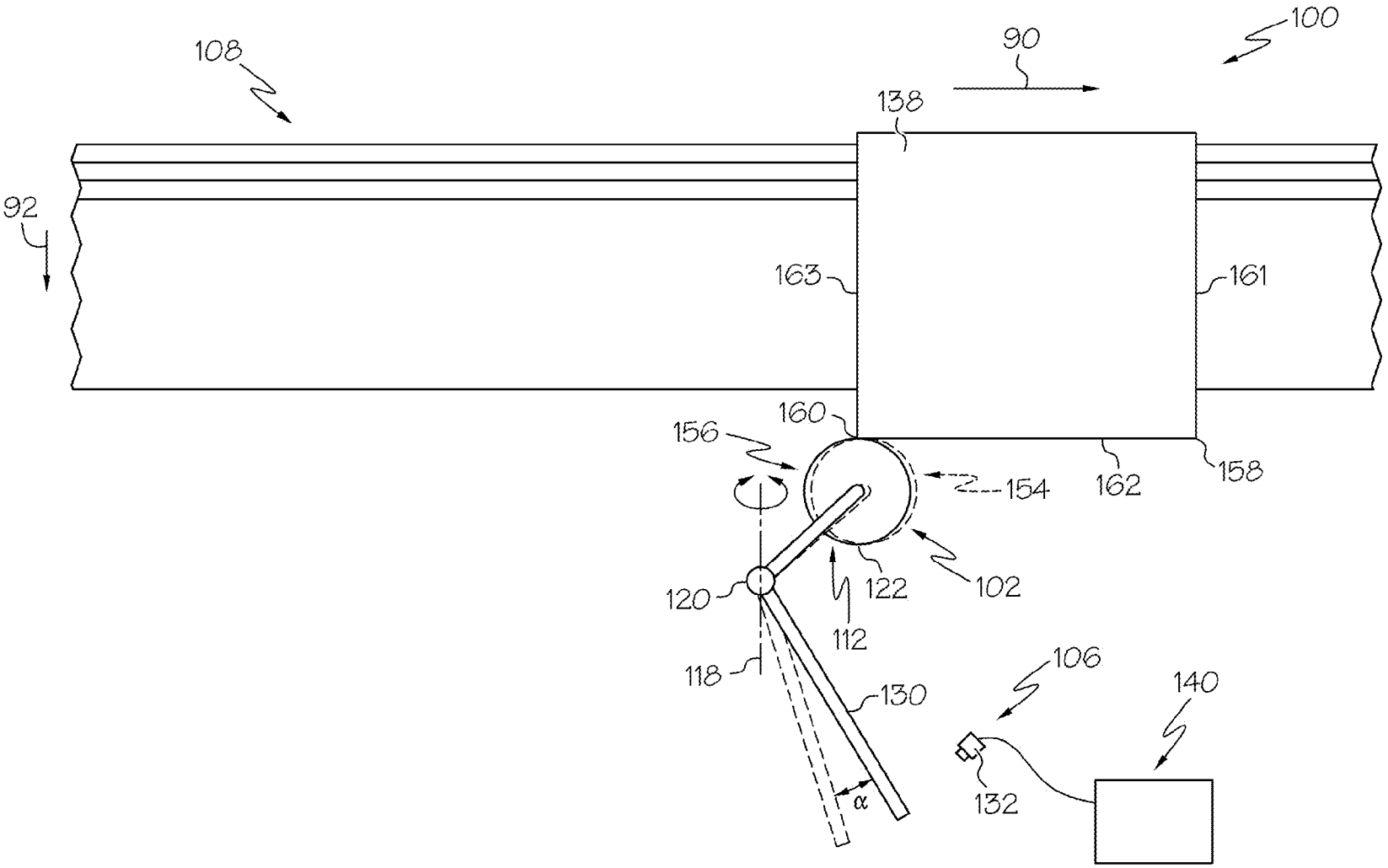
FIG. 8 schematically depicts a top view of the abrasive machining apparatus according to one or more embodiments described.

Referring now to FIG. 8, the computer readable logic that is executed by the controller 140 may also evaluate the position of the abrasive machining spindle 112 to retract the abrasive wheel 120 from the proximate edge 162 of the glass article 138 when the abrasive wheel 120 approaches the trailing corner of the glass article 138. Retracting the abrasive wheel 120 from the trailing corner of the glass article 138 may reduce the tendency of the abrasive wheel 120 to perform the abrasive machining operation on the trailing corner itself, which may lead to failure of the glass article 138.

While the abrasive machining spindle 112 is positioned in the engaged position 154, the controller 140 may evaluate the position of the abrasive machining spindle 112 and determine if the abrasive machining spindle 112 is pivoting away from the engaged position 154 and toward a fully extended position 156. Rotation of the abrasive machining spindle 112 from the engaged position 154 toward the fully extended position 156 may be indicative of reduced contact between the abrasive wheel 120 and the proximate edge 162 of the glass article 138. Reduced contact between the abrasive wheel 120 and the proximate edge 162 of the glass article 138 may occur when the trailing corner of the glass article 138 approaches the abrasive wheel 120. The reduction in contact between the abrasive wheel 120 and the glass article 138 corresponds to an increase in depth of contact between the abrasive wheel 120 and the glass article 138, which may occur proximate to the trailing corner, as the amount of material that can resist the force applied by the actuator 106 to maintain the position of the abrasive machining spindle 112 is reduced.

As the controller 140 detects from the edge finishing unit position sensor 132 that the pivot arm 130 (and therefore the abrasive machining spindle 112) is pivoting toward the fully extended position 156 from the engaged position 154, the controller 140 controls the actuator 106 to modify the application of force that is applied to the abrasive machining spindle 112 so that the abrasive machining spindle 112 may pivot toward the retracted position, thereby separating the abrasive wheel 120 from the proximate edge 162 of the glass article 138. In some embodiments, the actuator 106 may apply a force to the abrasive machining spindle 112 that pivots the abrasive machining spindle 112 toward the retracted position. In other embodiments, the actuator 106 may reduce the application of force to the abrasive machining spindle 112 so that the counterbalance assembly may apply a force to the abrasive machining spindle 112 that is greater than the force applied by the actuator 106 such that the counterbalance assembly pivots the abrasive machining spindle 112 toward the retracted position.

As discussed hereinabove, the abrasive machining apparatus 100 of the present disclosure includes logic within the computer readable instruction set that is capable of compensating for the wear of the abrasive wheel 120 as the abrasive wheel 120 machines multiple glass articles 138 over time. The processor 146 of the controller 140 processes the computer-readable logic to evaluate readings from the edge finishing unit position sensor 132 to evaluate the position of the abrasive machining spindle 112 when the abrasive wheel 120 is in engagement with the glass article 138. By evaluating the position of the abrasive machining spindle 112 over a variety of glass articles 138, the controller 140 may determine if the characteristic diameter 128 of the abrasive wheel 120 has changed after processing a plurality of glass articles 138.

In one embodiment, the processor 146 stores the position of the abrasive machining spindle 112 as a data variable that is associated with a baseline coordinate of the abrasive machining spindle 112 when the abrasive machining spindle 112 is in the engaged position 154. When the abrasive wheel 120 engages a subsequent glass article (not depicted), the edge finishing unit position sensor 132 again communicates the subsequent engagement data to the controller 140. The processor 146 of the controller 140 evaluates the data variables associated with the baseline coordinate and the subsequent engagement data to determine if the engaged position of the abrasive machining spindle 112 varies across the plurality of glass articles. If the position of the abrasive machining spindle 112 relative to the subsequent glass article is different from the data variable associated with the first glass article that is stored in the non-volatile memory 148, the controller may re-set the baseline coordinate of the abrasive machining spindle 112, thereby re-setting the position to which the abrasive machining spindle 112 is pivoted. The controller 140, therefore, commands the actuator 106 to pivot the abrasive machining spindle 112 according to the difference in the diameter of the abrasive wheel 120 to compensate for wear of the abrasive wheel 120. Through this process, the engaged position 154 of the abrasive machining spindle 112 can be modified to maintain a predetermined engagement depth and compensate for wear of the abrasive wheel 120.

Figure 9:
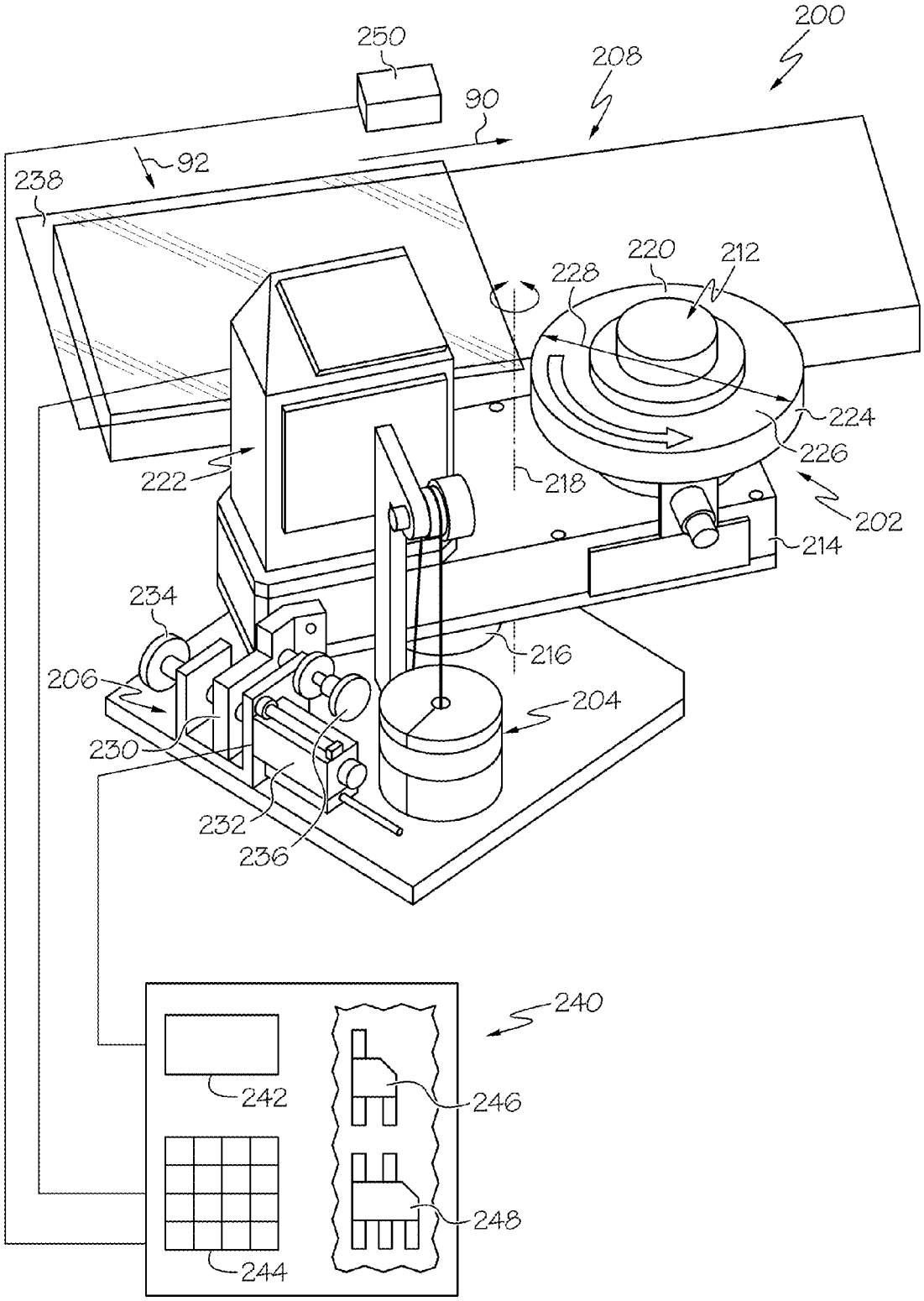
FIG. 9 herein schematically depicts a perspective view of an abrasive machining apparatus according to one or more embodiments described herein.

Referring now to FIG. 9, an abrasive machining apparatus 200 according to another embodiment includes an edge finishing unit 202, a counterbalance assembly 204, an actuator 206, a feed mechanism 208, an article position sensor 250, and a controller 240. The edge finishing unit 202 includes an abrasive machining spindle 212, a support base 214, and a pivot mechanism 216 that pivots about an axis 218. The abrasive machining spindle 212 of the edge finishing unit 202 has an abrasive wheel 220 coupled to a motor 222. The abrasive wheel 220 includes a form wheel 224 with an interior profile 226 that engages and machines a glass article 238. The form wheel 224 also has a characteristic diameter 228 that is measured at the narrowest position of the form wheel 224.

The edge finishing unit 202 is coupled to the counterbalance assembly 204 and the actuator 206. The counterbalance assembly 204 is coupled to the abrasive machining spindle 212 and to the support base 214 of the abrasive machining apparatus 200. The counterbalance assembly 204 is configured to apply a biasing force to the abrasive machining spindle 212 in a direction that tends to pivot the abrasive machining spindle 212 toward a retracted position.

The actuator 206 is coupled to the support base 214 and to the abrasive machining spindle 212 of the edge finishing unit 202. The actuator 206 selectively applies a force to the edge finishing unit 202 to pivot the abrasive machining spindle 212 between a retracted position and an extended position. In some embodiments, the actuator 206 may apply a force in a direction that pivots the abrasive machining spindle 212 toward the extended position. In such embodiments, the actuator 206 relies on the biasing force provided by the counterbalance assembly 204 to selectively reposition the abrasive machining spindle 212.

In the embodiment depicted in FIG. 9, the abrasive machining apparatus 200 includes a pivot arm 230 that is coupled to and extends from the abrasive machining spindle 212. The actuator 206 is coupled to the pivot arm 230. The pivot arm 230 may increase in the force that the actuator 206 can apply to the abrasive machining spindle 212 through improved leverage. The abrasive machining apparatus 200 may also include a plurality of mechanical stops 234, 236 that limit the rotation of the abrasive machining spindle 212.

The abrasive machining apparatus 200 also includes an edge finishing unit position sensor 232. In the embodiment depicted in FIG. 9, the edge finishing unit position sensor 232 is coupled to the support base 214 and evaluates a position of the pivot arm 230, whose position corresponds to the position of the abrasive machining spindle 212.

Still referring to FIG. 9, abrasive machining apparatus 200 includes a controller 240 that is electronically coupled to the actuator 206 and to the edge finishing unit position sensor 232. In some embodiments, the controller 240 is electronically coupled to a motor 222 of the edge finishing unit 202. The controller 240 includes a processor 246 and a non-volatile memory 248 that is electronically coupled to the processor 246 and stores a computer-readable instruction set. As depicted in FIG. 8, the controller 240 also includes a display 242 and a user interface 244 that are electronically coupled to the processor. In some embodiments, the controller 240 may be a programmable logic controller. In other embodiments, the controller may be a general purpose computer that includes input and output connections to accept inputs from at least the edge finishing unit position sensor 232 and deliver outputs to the actuator 206.

The controller 240, through instructions provided to the actuator 206, modifies the position of the pivot arm 230 relative to the support base 214. The controller 240 detects when the glass article 238 is in a position proximate to the abrasive wheel 220. When the controller 240 determines that the glass article 238 is in a position at which the edges of the glass article 238 can be processed, the controller 240 commands the actuator 206 to modify an application of force to the abrasive machining spindle 212 such that the abrasive machining spindle 212 pivots about the pivot mechanism 216 into an extended position where the abrasive wheel 220 processes the glass article 238. The feed mechanism 208 traverses the glass article 238 in the feed direction 90 as the glass article 238 is being processed. As the controller 240 detects that the glass article 238 is being translated away from a position at which the edges of the glass article 238 can be processed, the controller 240 commands the actuator 206 to modify the application of force to the abrasive machining spindle 212 such that the abrasive machining spindle 212 pivots about the pivot mechanism 216 into a retracted position where the abrasive wheel 220 is spaced apart from contact with the glass article 238 in the cross-feed direction 92.

In yet another embodiment (not shown), the abrasive machining apparatus may also include an article position sensor. The article position sensor is positioned on the feed mechanism and detects when the glass article is in position for engagement with the abrasive wheel. The article position sensor detects the position of the glass article relative to the abrasive wheel and communicates the position of the glass article to the controller. In some embodiments, the controller uses the data provided by the article position sensor to confirm the position of the glass article relative to the abrasive wheel to confirm engagement between the abrasive wheel and the glass article that is simultaneously communicated by the edge finishing unit position sensor to the controller. In another embodiment, the abrasive machining apparatus does not include an edge finishing unit position sensor. In such embodiments, when the article position sensor detects the position of the leading corner of the glass article and communicates it to the controller, the controller commands the actuator to modify the application of force to the pivot art to move the abrasive machining spindle into the engaged position. These commands from the controller may be based upon data provided by the article position sensor alone.

It should now be understood that the abrasive machining apparatus of the present disclosure includes an abrasive machining spindle, an actuator, a controller, and an edge finishing unit position sensor. The actuator selectively applies force to the abrasive machining spindle to pivot the abrasive machining spindle between a fully extended position and a fully retracted position. Prior to processing an edge of a glass article, the actuator may position the abrasive machining spindle in an initiation position between the fully extended position and the fully retracted position. Upon contact between the glass article and a component of the abrasive machining spindle, as detected by the edge finishing unit position sensor, the controller commands the actuator to pivot the abrasive machining spindle into an engaged position between the initiation position and the fully extended position. Detecting contact between the glass article and the component of the abrasive machining spindle may minimize any time between entry of the glass article into the abrasive machining apparatus and initiation of processing of the edge of the glass article, thereby increasing the portion of the glass article that is processed by the abrasive machining apparatus.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

According to a first aspect, there is provided an abrasive machining apparatus comprising: a support base; an edge finishing unit comprising: an abrasive machining spindle having an abrasive wheel coupled to a motor; and a pivot mechanism coupled to the support base and having an axis about which the abrasive machining spindle pivots, the abrasive machining spindle being pivotable between an extended position and a retracted position; an actuator coupled to the edge finishing unit and to the support base, wherein the actuator selectively positions the abrasive machining spindle about the axis between the extended position and the retracted position; and an edge finishing unit position sensor coupled to the support base and oriented to detect a position of the abrasive machining spindle between the extended position and the retracted position.

According to a second aspect, there is provided a method of finishing a glass article comprising: translating a glass article with a feed mechanism in a feed direction; positioning an abrasive machining spindle having an abrasive wheel in an initiation position in which the abrasive wheel is positioned to intersect of an edge of the glass article that is generally parallel to the feed direction; detecting when the abrasive wheel contacts the edge of the glass article at a position proximate to a leading corner of the glass article; subsequent to detecting that the abrasive wheel contacts the edge of the glass article, applying a force to the abrasive machining spindle with an actuator in a direction that tends to pivot the abrasive machining spindle in a cross-feed direction that is transverse to the feed direction and into the glass article; and processing the edge of the glass article by abrasive machining.

According to a third aspect, there is provided an abrasive machining apparatus for finishing glass comprising: a feed mechanism that translates a glass article in a feed direction; a support base; an edge finishing unit comprising: an abrasive machining spindle including an abrasive wheel coupled to a motor; and a pivot mechanism coupled to the support base and having an axis about which the abrasive machining spindle pivots, the abrasive machining spindle being pivotable between an extended position and a retracted position; an actuator coupled to the edge finishing unit and the support base, wherein the actuator selectively positions the abrasive machining spindle about the axis between the extended position and the retracted position; an edge finishing unit position sensor coupled to the support base and oriented to detect a position of the abrasive machining spindle between the extended position and the retracted position; and a controller comprising a processor and a non-volatile memory storing computer-readable logic that, when the computer-readable logic is executed by the processor, the controller: commands the actuator to maintain the abrasive machining spindle in an initiation position between the extended position and the retracted position; detects movement of the abrasive machining spindle from the initiation position with the edge finishing unit position sensor to determine when contact between the abrasive wheel and the glass article occurs; and commands the actuator to modify an application of force to pivot the abrasive machining spindle to an engaged position between the initiation position and the extended position after contact between the abrasive wheel and the glass article has occurred.

According to a fourth aspect, there is provided any of aspect 1 or 3, further comprising a counterbalance assembly that is coupled to the edge finishing unit and configured to apply a force to the edge finishing unit in a direction that pivots the abrasive machining spindle toward the extended position.

According to a fifth aspect, there is provided there is provided any aspects 1 to 4, wherein the edge finishing unit position sensor comprises an inductive proximity sensor.

According to a sixth aspect, there is provided any of aspects 1 to 2 and 4 to 5, further comprising a feed mechanism that translates a glass article in a feed direction.

According to a seventh aspect, there is provided any of aspects 1 to 6, wherein the abrasive machining spindle is pivotable about the axis between the extended position and the retracted position that are evaluated in a cross-feed direction that is transverse to the feed direction.

According to an eighth aspect, there is provided any of aspects 1 to 7, further comprising a glass article position sensor positioned upstream in the feed direction from the abrasive wheel, the glass article position sensor being positioned to detect a position of the glass article in the feed direction.

According to a ninth aspect, there is provided any of aspects 1 to 8, wherein an edge finishing unit position sensor detects that the abrasive wheel contacts the edge of the glass article when the abrasive wheel of the abrasive machining spindle is pivoted away from the edge of the glass article by contact between the abrasive wheel and the edge of the glass article at a position proximate to the leading corner of the glass article.

According to a tenth aspect, there is provided any of aspects 1 to 9, further comprising: subsequent to initiation of processing the edge of the glass article, detecting that the abrasive wheel contacts the edge of the glass article at a position proximate to a trailing corner of the glass article; and removing the application of force that is applied to the abrasive machining spindle with the actuator.

According to an eleventh aspect, there is provided any of aspects 1 to 10, further comprising subsequent to detecting that the abrasive wheel contacts the edge of the glass article at a position proximate to the trailing corner of the glass article, pivoting the abrasive machining spindle in the cross-feed direction and away from the glass article.

According to a twelfth aspect, there is provided any of aspects 1 to 11, wherein an edge finishing unit position sensor detects that the abrasive wheel contacts the edge of the glass article at a position proximate to the trailing corner of the glass article when the abrasive wheel is pivoted toward the glass article in the cross-feed direction by a reduction in contact between the edge of the glass article at a position proximate to the trailing corner of the glass article.

According to a thirteenth aspect, there is provided any of aspects 1 to 12, further comprising detecting a position of the glass article in the feed direction with an article position sensor.

According to a fourteenth aspect, there is provide any of aspect 3, wherein the computer-readable logic further comprises instructions that, when executed by the processor, the controller: detects movement of the abrasive machining spindle from the extended position away from the retracted position and toward the extended position; and commands the actuator to modify the application of force to pivot the abrasive machining spindle toward the retracted position.

According to a fifteenth aspect, there is provided any of aspect 3 or 14, wherein the computer-readable logic further comprises instructions that, when executed by the processor, the controller: evaluates a position of the abrasive machining spindle with the edge finishing unit position sensor while the abrasive wheel is in contact with the glass article; stores a data variable associated with a baseline coordinate of the abrasive machining spindle in the extended position in a memory; evaluates a position of the abrasive machining spindle with the edge finishing unit position sensor while the abrasive wheel is in contact with a second glass article; compares the position of the abrasive machining spindle relative to the second glass article with the data variable stored in the memory; and if the position of the abrasive machining spindle relative to the second glass article is different than the data variable stored in the memory, the processor modifies the baseline coordinate of the extended position of the abrasive machining spindle to compensate for wear of the abrasive wheel.

According to a sixteenth aspect, there is provided any of aspect 3, 14, or 15, wherein: the abrasive wheel comprises a form wheel having an interior profile and a characteristic diameter; and the controller modifies the extended position of the edge finishing unit based on the characteristic diameter of the form wheel.

According to a seventeenth aspect, there is provided any of aspects 3 or 14 to 16, further comprising an article position sensor that detects a position of the glass article in the feed direction, wherein the computer-readable logic further comprises instructions that, when executed by the processor, the controller: detects the position of the glass article in the feed direction to determine when the glass article is positioned proximate to the abrasive wheel; and command the actuator to modify an application of force to pivot the abrasive machining spindle to the extended position at a time after the glass article is positioned proximate to the abrasive wheel.

What is claimed is:

1. An abrasive machining apparatus comprising:

a support base;

an edge finishing unit comprising:

an abrasive machining spindle having an abrasive wheel coupled to a motor;

a pivot mechanism coupled to the support base and having an axis about which the abrasive machining spindle pivots, the abrasive machining spindle being pivotable between an extended position and a retracted position; and a pivot arm coupled to the abrasive machining spindle and pivotable relative to the support base;

an actuator coupled to the edge finishing unit and to the support base, wherein the actuator selectively positions the abrasive machining spindle about the axis between the extended position and the retracted position with the pivot arm; and an edge finishing unit position sensor coupled to the support base and oriented to detect a position of the pivot arm.

2. The abrasive machining apparatus of claim 1, further comprising a counterbalance assembly that is coupled to the edge finishing unit and configured to apply a force to the edge finishing unit in a direction that pivots the abrasive machining spindle toward the extended position.

3. The abrasive machining apparatus of claim 1, wherein the edge finishing unit position sensor comprises an inductive proximity sensor.

4. The abrasive machining apparatus of claim 1, further comprising a feed mechanism that translates a glass article in a feed direction.

5. The abrasive machining apparatus of claim 4, wherein the abrasive machining spindle is pivotable about the axis between the extended position and the retracted position that are evaluated in a cross-feed direction that is transverse to the feed direction.

6. The abrasive machining apparatus of claim 4, further comprising a glass article position sensor positioned upstream in the feed direction from the abrasive wheel, the glass article position sensor being positioned to detect a position of the glass article in the feed direction.

7. A method of finishing a glass article comprising:

translating a glass article with a feed mechanism in a feed direction;

positioning an abrasive machining spindle having an abrasive wheel in an initiation position in which the abrasive wheel is positioned to intersect an edge of the glass article that is generally parallel to the feed direction;

detecting when the abrasive wheel contacts the edge of the glass article at a position proximate to a leading corner of the glass article;

subsequent to detecting that the abrasive wheel contacts the edge of the glass article, applying a force to the abrasive machining spindle with an actuator in a direction that tends to pivot the abrasive machining spindle in a cross-feed direction that is transverse to the feed direction and into the glass article; and processing the edge of the glass article by abrasive machining.

8. The method of claim 7, wherein an edge finishing unit position sensor detects that the abrasive wheel contacts the edge of the glass article when the abrasive wheel of the abrasive machining spindle is pivoted away from the edge of the glass article by contact between the abrasive wheel and the edge of the glass article at a position proximate to the leading corner of the glass article.

9. The method of claim 8, wherein the edge finishing unit position sensor comprises an inductive proximity sensor.

10. The method of claim 7, further comprising:

subsequent to initiation of processing the edge of the glass article, detecting that the abrasive wheel contacts the edge of the glass article at a position proximate to a trailing corner of the glass article; and removing the application of force that is applied to the abrasive machining spindle with the actuator.

11. The method of claim 10, further comprising subsequent to detecting that the abrasive wheel contacts the edge of the glass article at a position proximate to the trailing corner of the glass article, pivoting the abrasive machining spindle in the cross-feed direction and away from the glass article.

12. The method of claim 10, wherein an edge finishing unit position sensor detects that the abrasive wheel contacts the edge of the glass article at a position proximate to the trailing corner of the glass article when the abrasive wheel is pivoted toward the glass article in the cross-feed direction by a reduction in contact between the edge of the glass article at a position proximate to the trailing corner of the glass article.

13. The method of claim 7, further comprising detecting a position of the glass article in the feed direction with an article position sensor.

14. An abrasive machining apparatus for finishing glass comprising:

a feed mechanism that translates a glass article in a feed direction;

a support base;

an edge finishing unit comprising:

an abrasive machining spindle including an abrasive wheel coupled to a motor; and a pivot mechanism coupled to the support base and having an axis about which the abrasive machining spindle pivots, the abrasive machining spindle being pivotable between an extended position and a retracted position;

an actuator coupled to the edge finishing unit and the support base, wherein the actuator selectively positions the abrasive machining spindle about the axis between the extended position and the retracted position;

an edge finishing unit position sensor coupled to the support base and oriented to detect a position of the abrasive machining spindle between the extended position and the retracted position; and a controller comprising a processor and a non-volatile memory storing computer-readable logic that, when the computer-readable logic is executed by the processor, the controller:

commands the actuator to maintain the abrasive machining spindle in an initiation position between the extended position and the retracted position;

detects movement of the abrasive machining spindle from the initiation position with the edge finishing unit position sensor to determine when contact between the abrasive wheel and the glass article occurs; and commands the actuator to modify an application of force to pivot the abrasive machining spindle to an engaged position between the initiation position and the extended position after contact between the abrasive wheel and the glass article has occurred.

15. The abrasive machining apparatus of claim 14, wherein the edge finishing unit further comprises a counterbalance assembly that is coupled to the edge finishing unit and configured to apply a force to the edge finishing unit in a direction that pivots the abrasive machining spindle toward the extended position.

16. The abrasive machining apparatus of claim 14, wherein the computer-readable logic further comprises instructions that, when executed by the processor, the controller:

detects movement of the abrasive machining spindle from the extended position away from the retracted position and toward the extended position; and commands the actuator to modify the application of force to pivot the abrasive machining spindle toward the retracted position.

17. The abrasive machining apparatus of claim 14, wherein the computer-readable logic further comprises instructions that, when executed by the processor, the controller:

evaluates a position of the abrasive machining spindle with the edge finishing unit position sensor while the abrasive wheel is in contact with the glass article;

stores a data variable associated with a baseline coordinate of the abrasive machining spindle in the extended position in a memory;

evaluates a position of the abrasive machining spindle with the edge finishing unit position sensor while the abrasive wheel is in contact with a second glass article;

compares the position of the abrasive machining spindle relative to the second glass article with the data variable stored in the memory; and if the position of the abrasive machining spindle relative to the second glass article is different than the data variable stored in the memory, the processor modifies the baseline coordinate of the extended position of the abrasive machining spindle to compensate for wear of the abrasive wheel.

18. The abrasive machining apparatus of claim 14, wherein:

the abrasive wheel comprises a form wheel having an interior profile and a characteristic diameter; and the controller modifies the extended position of the edge finishing unit based on the characteristic diameter of the form wheel.

19. The abrasive machining apparatus of claim 14, further comprising an article position sensor that detects a position of the glass article in the feed direction, wherein the computer-readable logic further comprises instructions that, when executed by the processor, the controller:

detects the position of the glass article in the feed direction to determine when the glass article is positioned proximate to the abrasive wheel; and command the actuator to modify an application of force to pivot the abrasive machining spindle to the extended position at a time after the glass article is positioned proximate to the abrasive wheel.

* * * * *